United States Patent [19]

Schilling

[11] 4,211,526

[45] Jul. 8, 1980

[54] CONTROL SYSTEM FOR REDUNDANT VALVES

[75] Inventor: Roger A. Schilling, West St. Paul, Minn.

[73] Assignee: Honeywell Inc., Minneapolis, Minn.

[21] Appl. No.: 957,956

[22] Filed: Nov. 6, 1978

[51] Int. Cl.[2] ..... F23N 5/00

[52] U.S. Cl. ..... 431/69; 431/66; 431/78

[58] Field of Search ..... 431/67, 66, 69, 73, 431/77, 78, 71, 79, 80, 45

[56] References Cited

U.S. PATENT DOCUMENTS

| | | | |
|---|---|---|---|
| 3,026,932 | 3/1962 | Algino | 431/77 |
| 3,597,139 | 8/1971 | Elders | 431/66 |
| 3,603,708 | 9/1971 | Good | 431/45 |
| 3,619,097 | 11/1971 | Clay | 431/80 |
| 3,807,933 | 4/1974 | Fernstrom | 431/66 |
| 3,914,092 | 10/1975 | Matthews | 431/66 |

*Primary Examiner*—Carroll B. Dority, Jr.
*Assistant Examiner*—Lee E. Barrett
*Attorney, Agent, or Firm*—Alfred N. Feldman

[57] ABSTRACT

An electronic control system for safely operating a pair of redundant solenoid type valves is disclosed. The system utilizes an alternating current potential for energizing the valves. The first valve is energized across the applied potential and then is placed in series with the second valve. The series combination is selected so that once the valves are energized they will stay energized in the series configuration.

9 Claims, 1 Drawing Figure

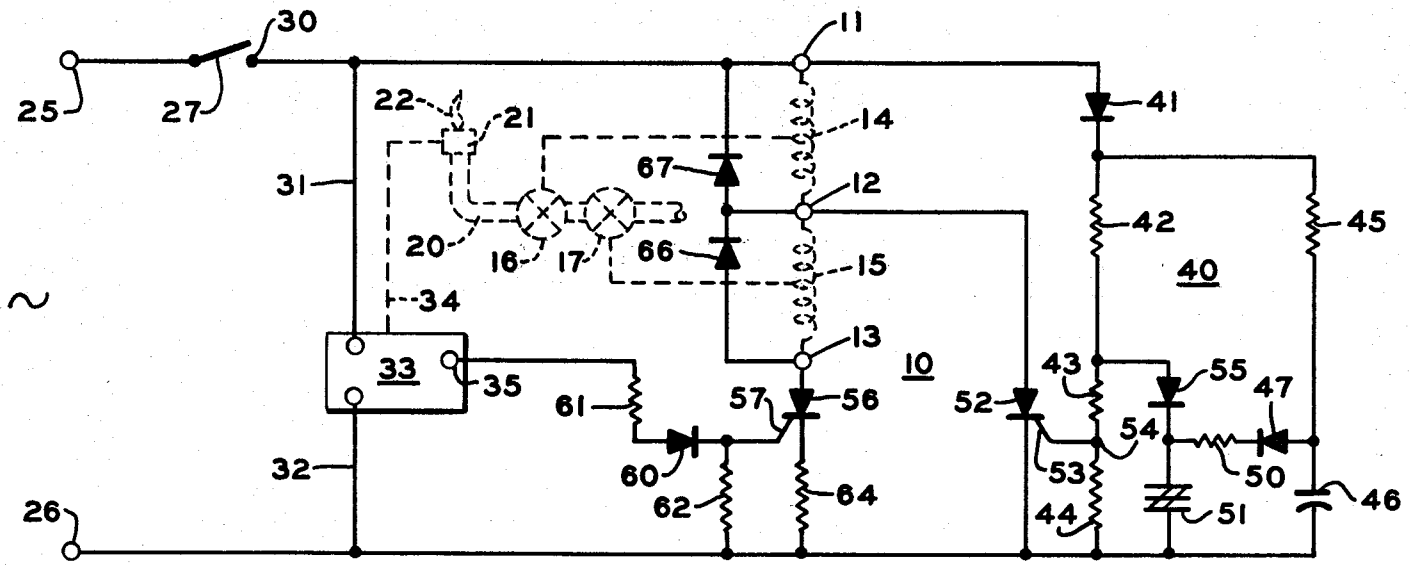
45
46
47
50
51
55
40
41
42
54
43
53
44
52
10
11
14
12
15
13
56
64
57
62
67
66
60
61
17
16
21
35
22
20
34
33
30
31
32
27
25
26

CONTROL SYSTEM FOR REDUNDANT VALVES

BACKGROUND OF THE INVENTION

Since the advent of the sharp rise in fuel prices and the possibility of fuel shortages, a number of conservation measures have been undertaken. Certain of the conservation ideas for gaseous fuels have been mandated by state legislatures. It has been common practice for many years to use a very simple, inexpensive and reliable pilot arrangement for gas fired equipment. In the past it has been common to use a standing pilot, that is one that continuously burns and is monitored by a flame sensing device, such as a thermocouple. This type of a system has proved to be very inexpensive and reliable. Many state legislatures have now mandated that the standing pilot is not in the country's best interest in fuel conservation, and the standing pilot must be replaced with some other type of fuel ignition arrangement.

One type of fuel ignition arrangement that is coming into prominence is a system normally referred to as a direct spark ignition system. In this type of system an electric spark is generated across a gap to ignite a gaseous fuel as it emanates from a gas burner. This type of an arrangement, while it appears to be simple and straightforward, creates some very serious safety problems. Firstly, there is a problem of properly igniting a fuel. Secondly, there is the problem of a gas valve failure which would allow for the continuous flow of raw fuel into a burner when none was required. This can be not only wasteful, but very hazardous. In order to alleviate the hazard in a direct spark ignition type of system, it has become common, and even required, that two gas valves be placed in series so that the failure of one valve will not preclude the closing of the fuel flow channel by the second valve. This type of an arrangement is generally referred to as a redundant valve arrangement.

Where valves are controlled electronically, an additional problem is created in that electronic components may fail in modes which may cause an unsafe condition in a direct spark ignition system. Any direct spark ignition system for control of fuel flow valves must take into consideration the failure modes of the electronic components and, therefore, must be designed so that any component failure causes a shut down of fuel flow. This is considered to be the safe mode of failure.

SUMMARY OF THE INVENTION

The present invention is an electronic control system for redundant fluid flow valves, more particularly gas valves used in a direct spark ignition type of fuel burner. The redundant valves are placed in mechanical series to control the gas flow to a burner. The valves are electrically controlled by solenoid operators in a conventional fashion, but with the solenoid coils adapted to be connected into the control circuit in a unique manner. The first gas valve solenoid is connected into the circuit through a solid state switch means that is briefly energized upon a call for heat. The second solenoid valve coil is energized through the first coil in a series circuit and the solid state switch means that controls the second solenoid valve is controlled in a unique manner. The second solid state switch is initially energized as if a flame existed, and is then caused to operate solely in response to the presence of a flame. The valve coils are arranged in a series circuit through a fusible element that acts as a safety or fuse in the event of a shorting of the solid state switch means.

With the novel arrangement provided, the failure of any of the solid state switching components causes the system to either shut down one or more of the valves immediately, or will cause the system to refuse to start if the system was in normal operation at the time of the failure.

BRIEF DESCRIPTION OF THE DRAWING

The single FIGURE is a schematic diagram of an electronic control system for redundant fluid flow valves.

DESCRIPTION OF THE PREFERRED EMBODIMENT

An electronic control system for redundant fluid flow valves is generally disclosed at 10. In the present discussion the system will be described as a redundant gas flow system for conventional gas that is supplied to a furnace or similar fuel burning appliance. The electronic control system 10 is adapted to be connected by terminals 11, 12 and 13 to the solenoid coils 14 and 15 of two gas valves generally disclosed at 16 and 17. The two gas valves 16 and 17 are connected in a gas flow pipe or channel 20 which in turn terminates in a burner 21. A gas flame is disclosed at 22. The equipment described to this point is conventional and is not directly part of the present invention. The invention is to the control system 10 for operating the two gas valves 16 and 17 in a safe manner.

The control system 10 is energized from a pair of conventional alternating current terminals 25 and 26. The terminal 25 is connected through a switch 27 which may be a manual switch or in a more conventional type of system would be a thermostat. The type of switch 27 is not material.

The closing of switch 27 applies an alternating current potential to an input terminal 30 for the control system 10. A pair of conductors 31 and 32 supply power to a condition responsive means 33. The condition responsive means has any convenient means 34 for monitoring the flame 22 at the burner 21. This could be a simple flame rod, flame rectification system, photocell or ultraviolet arrangement. The only requirement is that the condition responsive means 33 can be capable of monitoring the condition or flame 22 and provide a control output on a terminal 35. The condition responsive means 33 also has a rather unusual function in that an output appears at the terminal 35 for a short period each time power is applied on conductors 31 and 32. A similar type of condition responsive or flame detection system can be found in the U.S. Pat. No. 3,619,097 to Homer B. Clay which issued on Nov. 9, 1971 to the assignee of the present application. The Clay patent contains a capacitor voltage divider network which briefly energizes a device so that a flame can be established at an associated burner. If a flame is established, the voltage divider network is kept continuously recharged. If no flame is present, the voltage divider bleeds off and the system locks itself out. A similar arrangement could be provided in the present electronic control system 33 to provide a momentary or brief output on conductor 35. The means 33 then must respond to a flame via the sensor 34 within a set period of time. This function is necessary for the proper operation of the inventive system, and it will be described in more detail in connection with the operation of the system.

The terminal 30, in addition to supplying power to the condition responsive means 33, supplies power to the terminal 11 and to a timing circuit means generally disclosed at 40. The timing circuit means 40 includes a rectifying diode 41 connected in series with a resistor 42 and two further resistors 43 and 44. It is obvious that as soon as power is applied to the terminal 11, that a current flows each half cycle through the diode 41 and the series resistors 42, 43 and 44.

At the same time as current is flowing in the resistors 42, 43 and 44 current flows through the resistor 45 to a capacitor 46 where a charge is stored. When the charge on 46 reaches a sufficient level, the voltage on the capacitor 46 forces current to pass through a diode 47, a resistor 50 and to a silicon bilateral switch 51. The silicon bilateral switch 51 could be replaced by any convenient voltage breakdown means. Also associated with this circuit is a further diode 55 which connects the voltage divider of resistors 42, 43 and 44 to the silicon bilateral switch 51. The timing circuit means 41 is completed by the addition of a solid state switch means 52 which has been disclosed as a silicon controlled rectifier. The gate 53 of the silicon controlled rectifier is connected to a point 54 which is common to the resistors 43 and 44. It is quite apparent that when an appropriate voltage is supplied at the junction 54 to the gate 53 of the switch means 52, that current will flow through the solenoid valve coil 14 and the silicon controlled rectifier or switch means 52 will energize the valve 16.

The present control system 10 is completed by the addition of a further solid state switch means or 56 which is connected in series with the terminal 13 along with the solenoid 15 and the solenoid 14 to the terminal 11. The solid state switch means 56 has a gate 57 that is connected by a diode 60 and a resistor 61 to the terminal 35 of the condition responsive means 33. A further biasing resistor 62 is provided in the gate circuit of the silicon controlled rectifier 56. The circuitry further includes a current responsive safety means 64 that has been disclosed as a simple resistor. The current responsive safety means 64 can be a resistor or other type of fusible element which will open circuit when an excessive amount of current flows therethrough. The electronic control system 10 is completed by the addition of a pair of diodes 66 and 67 that are connected in parallel with the solenoid coils 14 and 15, but are poled opposite to the direction of current flow for the silicon controlled rectifier 56. The function of the diodes will be described subsequently.

OPERATION

If it is assumed that the switch 27 has been open and, therefore, the valves 16 and 17 have been deenergized and are closed, there obviously will be no flame 22 and the condition responsive means 33 will have no output at terminal 35. As soon as the switch 27 is closed, the condition responsive means 33 generates a voltage output at terminal 35 that is immediately transmitted to the gate 57 of the silicon controlled rectifier 56 so that the silicon controlled rectifier 56 can begin to conduct current through the solenoids 14 and 15. Due to the impedance of this circuit, the solenoid 14 will not open the valve 16, but the solenoid 15 is capable of opening the valve 17.

At the same time as power is applied on conductor 31 to the condition responsive means 33, power is supplied through the diode 41 and the voltage divider network made up of the resistors 42, 43 and 44 as well as to the capacitor 46. Since the capacitor 46 requires some time to charge, the immediate effect is to generate a voltage at the junction 54 which gates the silicon controlled rectifier 52 into conduction. The conduction of the silicon controlled rectifier 52 immediately causes the solenoid 14 to be energized and the valve 16 to open. At this point both the valves 16 and 17 are open, and a source of ignition (which has not been shown) is applied to the burner 21. The source of ignition typically would be a spark source that is controlled by the condition responsive means 33. The source of ignition could be of any other type, and is not material to the present invention.

Under normal operation, the ignition source would light the gas passing through the conduit or pipe 20 and a flame 22 would appear which would be sensed by the condition sensing means 33 and a continuing output would be provided on terminal 35 to keep the silicon controlled rectifier 56 in conduction. During this same period of time the capacitor 46 charges until the voltage across the silicon bilateral switch 51 reaches its breakover point. At the time the potential across the silicon bilateral switch 51 reaches its breakdown potential, the silicon bilateral switch 51 starts to conduct through the diode 55 and effectively shorts out the gate 53 of the silicon controlled rectifier 52. This removes the pullin circuit for the solenoid 14. The solenoid 14 is selected so that it must be pulled in through the switch means 52 from terminal 11 to the terminal 26, but can be readily held in by a current flowing through the solenoid 15 and the silicon controlled rectifier 56 along with the current responsive safety means 64. The current flowing under these conditions is not sufficient to activate the current responsive safety means 64. If it were a fusible element or a resistor, a sufficient current would burn the element open. This will occur only when an unsafe failure has occurred in other components. Up to this point the normal operation of the circuit has been described and the flame 22 will continue to burn under the supervision of the condition responsive means 33 as long as the switch 27 is closed. Obviously, the opening of switch 27 deactivates both valves 16 and 17 and shuts the system down in a safe manner.

Certain types of component failures are not uncommon in electronic control systems, and the present arrangement protects against most types of component failure. The component failures protected against include the shorting and opening of the two silicon controlled rectifiers. If the silicon controlled rectifier 52 shorts, the solenoid 15 is effectively shorted to ground and cannot be energized. If the silicon controlled rectifier 52 open circuits, the solenoid 14 of valve 16 does not receive a sufficient current flow at any time to open the valve 16. If the silicon controlled rectifier 56 shorts, there is a substantially direct circuit through the current responsive safety means 64 and the diodes 66 and 67 on each half cycle. This causes the element 64 to open circuit.

If the silicon controlled rectifier 56 acts like a diode, the valve 17 cannot be opened until the solenoid 14 has been energized on the startup of a system operation. The last type of failure that is significant is if the condition responsive means 33 provides a false flame signal to the silicon controlled rectifier 56 when it should not. In this case the silicon controlled rectifier 56 acts as if it were a diode and the entire system could only start when the solenoid 14 was energized by the operation of the silicon controlled rectifier 52.

As can be seen from the simple arrangement of valve coils and electronic components, a very safe manner of redundant operation of gas valves has been provided. It is quite apparent that the electronic components could be altered in their makeup and the various combinations of elements could provide the functions above described. For this reason, the applicant wishes to be limited in the scope of his invention solely by the scope of the appended claims.

The embodiments of the invention in which an exclusive property or right is claimed are defined as follows:

1. An electronic control system for redundant fluid flow valves that are adapted to be energized from an alternating current potential, including: condition responsive means adapted to be connected to a source of alternating current potential and capable of generating an initial timed output signal simulating the presence of a sensed condition, and then responding to the presence or absence of said sensed condition; said condition responsive means having an output signal when said condition is sensed timing circuit means energized concurrently with said condition responsive means with said timing circuit means including solid state switch means which is immediately caused to be conductive and subsequently is timed to a non-conductive state; said solid state switch means adapted to energize a first of said fluid flow valves to open said first valve when said solid state switch means conducts; second solid state switch means controlled by said condition responsive means with said second solid state switch means being conductive whenever said condition responsive means has either of said output signals; and said second solid state switch means adapted to connect a second of said fluid flow valves in a series circuit with said first fluid flow valve and current responsive safety means across said alternating current potential to maintain said valves in an energized state.

2. An electronic control system as described in claim 1 wherein said condition responsive means is flame responsive means; and said fluid flow valves are adapted to control the flow of a fuel to a burner.

3. An electronic control system as described in claim 2 wherein said solid state switch means each include a silicon controlled rectifier in a current path for each of said valves.

4. An electronic control system as described in claim 3 wherein said timing circuit means includes first circuit means to immediately gate a first silicon controlled rectifier into conduction upon application of said alternating current potential; and said timing circuit means further including relaxation oscillator means to timeout a safe start period for said control system and then remove the gating voltage from said first silicon controlled rectifier.

5. An electronic control system as described in claim 4 wherein said relaxation oscillator means includes current storage means and voltage breakdown means with said current storage means storing current until a voltage sufficiently high to activate said voltage breakdown means is present; said voltage breakdown means being activated to disable said first silicon controlled rectifier from conducting on a subsequent cycle of said alternating current potential.

6. An electronic control system as described in claim 5 wherein said current storage means is a capacitor and said voltage breakdown means is a silicon bilateral switch.

7. An electronic control system as described in claim 5 wherein a diode is adapted to be connected in parallel with each of said valves with said diodes poled to conduct in opposition to said silicon controlled rectifiers.

8. An electronic control system as described in claim 7 wherein said current responsive safety means is a fusible element.

9. An electronic control system as described in claim 7 wherein said current responsive safety means is a resistor.

* * * * *